US011441259B2

(12) United States Patent
Woo et al.

(10) Patent No.: US 11,441,259 B2
(45) Date of Patent: Sep. 13, 2022

(54) CLOTHES CARE DEVICE

(71) Applicant: SAMSUNG ELECTRONICS CO., LTD., Suwon-si (KR)

(72) Inventors: Jihyun Woo, Suwon-si (KR); Jeonghoon Kang, Suwon-si (KR); Hyeongjoon Park, Suwon-si (KR); Eun-Suk Bang, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/941,165

(22) Filed: Jul. 28, 2020

(65) Prior Publication Data

US 2021/0032799 A1 Feb. 4, 2021

(30) Foreign Application Priority Data

Aug. 1, 2019 (KR) ..... 10-2019-0094049

(51) Int. Cl.
*D06F 87/00* (2006.01)
*D06F 39/00* (2020.01)

(52) U.S. Cl.
CPC ..... *D06F 87/00* (2013.01); *D06F 39/008* (2013.01)

(58) Field of Classification Search
None
See application file for complete search history.

(56) References Cited

U.S. PATENT DOCUMENTS 3,742,629 A * 7/1973 Plasko ..... D06F 87/00 38/69
2008/0000098 A1* 1/2008 Choi ..... D06F 58/30 34/114
2009/0151193 A1* 6/2009 Moon ..... D06F 58/10 34/621
2013/0287374 A1 10/2013 Beck et al.
2016/0355968 A1* 12/2016 Song ..... D06F 39/008

FOREIGN PATENT DOCUMENTS

| | | |
|---|---|---|
| KR | 10-2009-0105127 | 10/2009 |
| KR | 10-2010-0121201 | 11/2010 |
| KR | 10-1155003 | 6/2012 |
| KR | 10-2013-0053216 | 5/2013 |
| KR | 10-1597108 | 2/2016 |
| KR | 10-2016-0142122 | 12/2016 |

OTHER PUBLICATIONS

International Search Report dated Nov. 2, 2020 from International Application No. PCT/KR2020/008530, 3 pages.

* cited by examiner

*Primary Examiner* — Cristi J Tate-Sims
(74) *Attorney, Agent, or Firm* — Staas & Halsey LLP

(57) ABSTRACT

A clothes care device having a steam spray nozzle of an improved structure. The clothes care device includes: a main body including a clothes care chamber of which a front side opens; a steam generator configured to supply a steam to inside of the clothes care chamber; and a steam spray configured to receive a steam from the steam generator and spraying the steam to the clothes care chamber, wherein the steam spray includes a steam nozzle in which the steam spray opening is formed, a nozzle cover coupled to the steam nozzle, wherein a steam inlet is formed in the nozzle cover, and a guide member positioned inside the nozzle cover and covering at least one portion of a moving path of a steam entered through the steam inlet.

23 Claims, 17 Drawing Sheets

CLOTHES CARE DEVICE

CROSS-REFERENCE TO RELATED APPLICATION

This application is based on and claims priority under 35 U.S.C. § 119 to Korean Patent Application No. 10-2019-0094049, filed on Aug. 1, 2019 in the Korean Intellectual Property Office, the disclosure of which is incorporated by reference herein in its entirety.

BACKGROUND

1. Field

The disclosure relates to a clothes care device, and more particularly, to a clothes care device for removing dust gathered on clothes or smell permeated in clothes.

2. Description of the Related Art

A clothes care device is equipment for clothes care, such as drying wet clothes, removing dust gathered on clothes or smell permeated in clothes, and smoothing out the wrinkles of clothes.

In general, the clothes care device includes a cabinet forming a clothes care chamber in which clothes are accommodated, and a door for opening or closing the cabinet.

The clothes care device includes a hot air supplier for supplying hot air to the clothes care chamber to dry clothes, and a steam generator for performing refresh functions, such as smoothing out the wrinkles of clothes, deodorizing clothes, and removing the static electricity of clothes.

The clothes care device including the steam generator includes a steam spray pipe and a steam spray nozzle for supplying a steam generated by the steam generator to the clothes care chamber in which clothes are accommodated.

SUMMARY

In accordance with an aspect of the disclosure, a clothes care device includes: a main body including a clothes care chamber of which a front side opens;

a steam generator configured to supply a steam to inside of the clothes care chamber; and a steam spray configured to receive a steam from the steam generator and spray the steam to the clothes care chamber, wherein the steam spray includes a steam nozzle in which a steam spray opening is formed, a nozzle cover coupled to the steam nozzle, wherein a steam inlet is formed in the nozzle cover, and a guide member positioned inside the nozzle cover and covering at least one portion of a moving path of a steam entered through the steam inlet.

The guide member may include a first guide positioned on the moving path of the steam entered through the steam inlet and configured to mitigate pressure of the steam, and a second guide positioned outside the first guide and configured to mitigate a rotation force of the steam.

The first guide may include a plurality of poles.

The second guide may include a rib positioned in a horizontal direction in a lower edge of the first guide.

A cross section of the first guide may be at least one of a straight line, a quadrangle, a triangle, or a curve.

The plurality of poles may be spaced from each other.

A gap may be formed between the first guide and the second guide.

The steam spray opening may be formed with a horizontal length l1 that changes according to an internal volume W of the clothes care chamber and is maintained at a preset ratio with respect to a left-right length L1 of the clothes care chamber.

An area w of the steam spray opening may be defined by a vertical length h1 and the horizontal length l1, and the vertical length h1 and the horizontal length l1 of the steam spray opening may change according to the internal volume W of the clothes care chamber, while the area w of the steam spray opening may be maintained.

The steam nozzle may include a condensed water outlet for discharging condensed water.

The clothes care chamber may form a circulating flow path for circulating inside air, and may include a first air flow inlet which air of the clothes care chamber enters, and a first air flow outlet connected to the first air flow inlet and discharging air to the clothes care chamber, wherein an outlet grille may be provided in the first air flow outlet.

The outlet grille may include an outlet guide forming an outlet hole, and the outlet guide may include an inclined surface.

An angle of the inclined surface may range from 60° to 85°.

The inclined surface may include a first angle of a first position at which air enters, and a second angle of a second position at which air is discharged.

Each of the first angle and the second angle may range from 60° to 85°.

In accordance with another aspect of the disclosure, a clothes care device includes: a main body forming a clothes care chamber; a steam generator configured to supply a steam to inside of the clothes care chamber; and a steam spray including a steam inlet receiving a steam from the steam generator, and a steam spray opening spraying the steam to the clothes care chamber, wherein the steam spray includes a guide member covering at least one portion of a moving path of a steam entered through the steam inlet and configured to mitigate pressure of the steam.

The guide member may include a first guide including a plurality of poles positioned on the moving path of the steam and spaced from each other, and a second guide positioned outside the first guide and configured to mitigate a rotation force of the steam.

The second guide may include a rib positioned in a horizontal direction in a lower edge of the first guide.

A cross section of the first guide may be at least one of a straight line, a quadrangle, a triangle, or a curve.

The steam spray opening may be formed with a horizontal length l1 that changes according to an internal volume W of the clothes care chamber and is maintained at a preset ratio with respect to a left-right length L1 of the clothes care chamber.

In accordance with another aspect of the disclosure, a clothes care device includes: a main body forming a clothes care chamber; a steam generator configured to supply a steam to inside of the clothes care chamber; and a steam spray comprising a steam inlet receiving a steam from the steam generator and a steam spray opening spraying the steam to the clothes care chamber, wherein an area w of the steam spray opening is formed with a horizontal length l1 that changes according to an internal volume W of the clothes care chamber and is maintained at a preset ratio with respect to a left-right length L1 of the clothes care chamber.

The area w of the steam spray opening may be defined by a vertical length h1 and the horizontal length l1, and the vertical length and the horizontal length l1 of the steam spray opening may change according to the internal volume W of the clothes care chamber, while the area w of the steam spray opening may be maintained.

The horizontal length l1 of the steam spray opening may change at a preset ratio with respect to a horizontal length L1 of the clothes care chamber.

Additional aspects of the disclosure will be set forth in part in the description which follows and, in part will be obvious from the description, or may be learned by practice of the disclosure.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
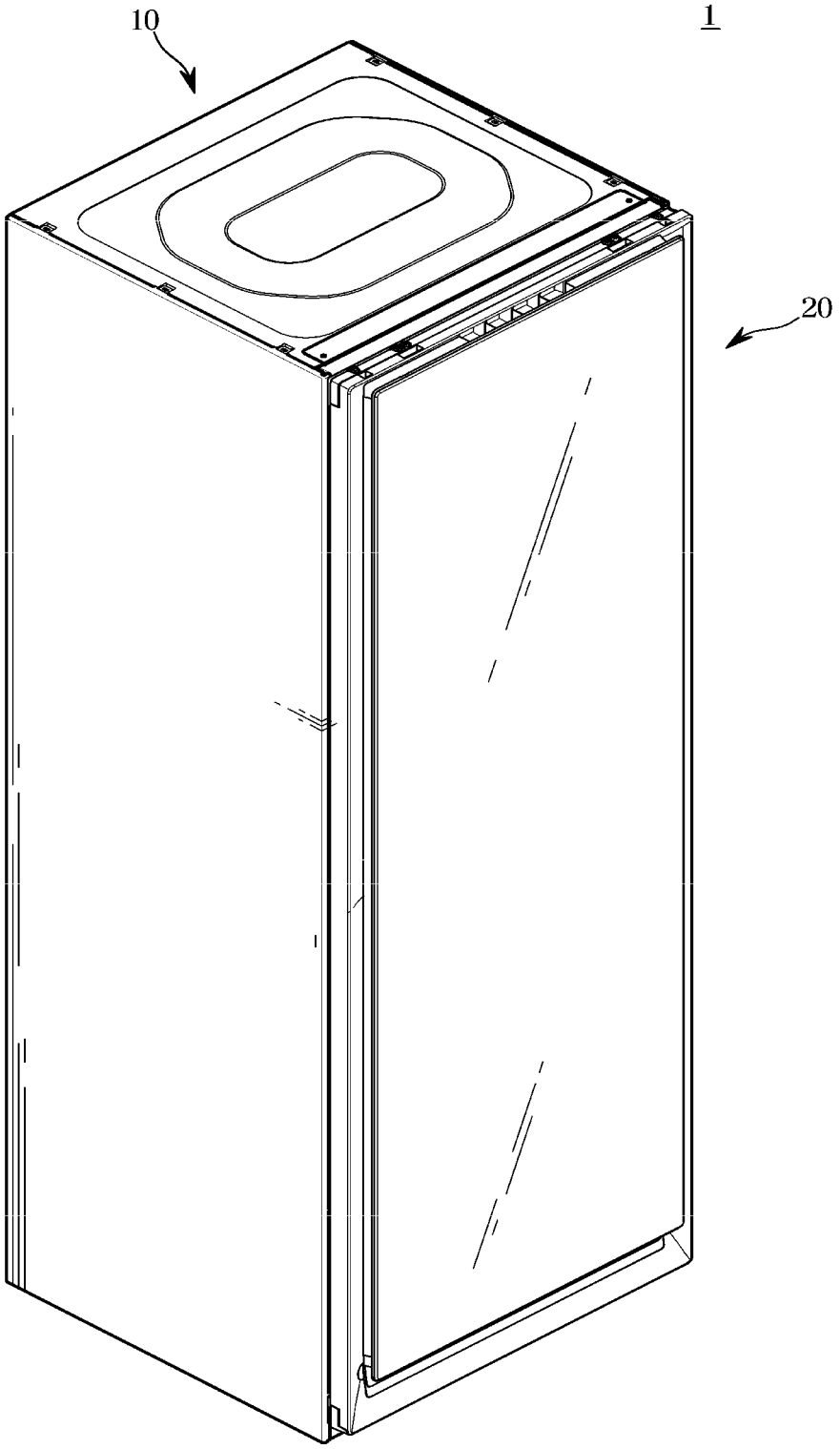
FIG. 1 is a perspective view of a clothes care device according to an embodiment of the disclosure.

Configurations illustrated in the embodiments and the drawings described in the present specification are only the preferred embodiments of the disclosure, and thus it is to be understood that various modified examples, which may replace the embodiments and the drawings described in the present specification, are possible when filing the present application.

Like reference numerals or symbols denoted in the drawings of the present specification represent members or components that perform the substantially same functions.

Also, the terms used in the present specification are merely used to describe embodiments, and are not intended to limit and/or restrict the disclosure. An expression used in the singular encompasses the expression of the plural, unless it has a clearly different meaning in the context. In the present specification, it is to be understood that the terms such as "including" or "having," etc., are intended to indicate the existence of the features, numbers, operations, components, parts, or combinations thereof disclosed in the specification, and are not intended to preclude the possibility that one or more other features, numbers, operations, components, parts, or combinations thereof may exist or may be added.

Also, it will be understood that, although the terms "first", "second", etc., may be used herein to describe various components, these components should not be limited by these terms. The above terms are used only to distinguish one component from another. For example, a first component discussed below could be termed a second component, and similarly, a second component may be termed a first component without departing from the scope of right of the disclosure. As used herein, the term "and/or" includes any and all combinations of one or more of associated listed items.

Throughout the disclosure, the expression "at least one of a, b or c" indicates only a, only b, only c, both a and b, both a and c, both b and c, all of a, b, and c, or variations thereof.

Therefore, it is an aspect of the disclosure to provide a clothes care device having a steam spray nozzle with an improved structure.

It is another aspect of the disclosure to provide a clothes care device having a steam spray nozzle capable of improving steam transfer efficiency.

It is another aspect of the disclosure to provide a clothes care device having a steam spray nozzle capable of forming a flow to spray a steam in a preset direction.

It is another aspect of the disclosure to provide a clothes care device capable of improving steam transfer efficiency with respect to clothes by changing a left-right length of a steam spray opening according to a change of an internal volume of a clothes care chamber.

Hereinafter, the embodiments of the disclosure will be described in detail with reference to the accompanying drawings.

Figure 2:
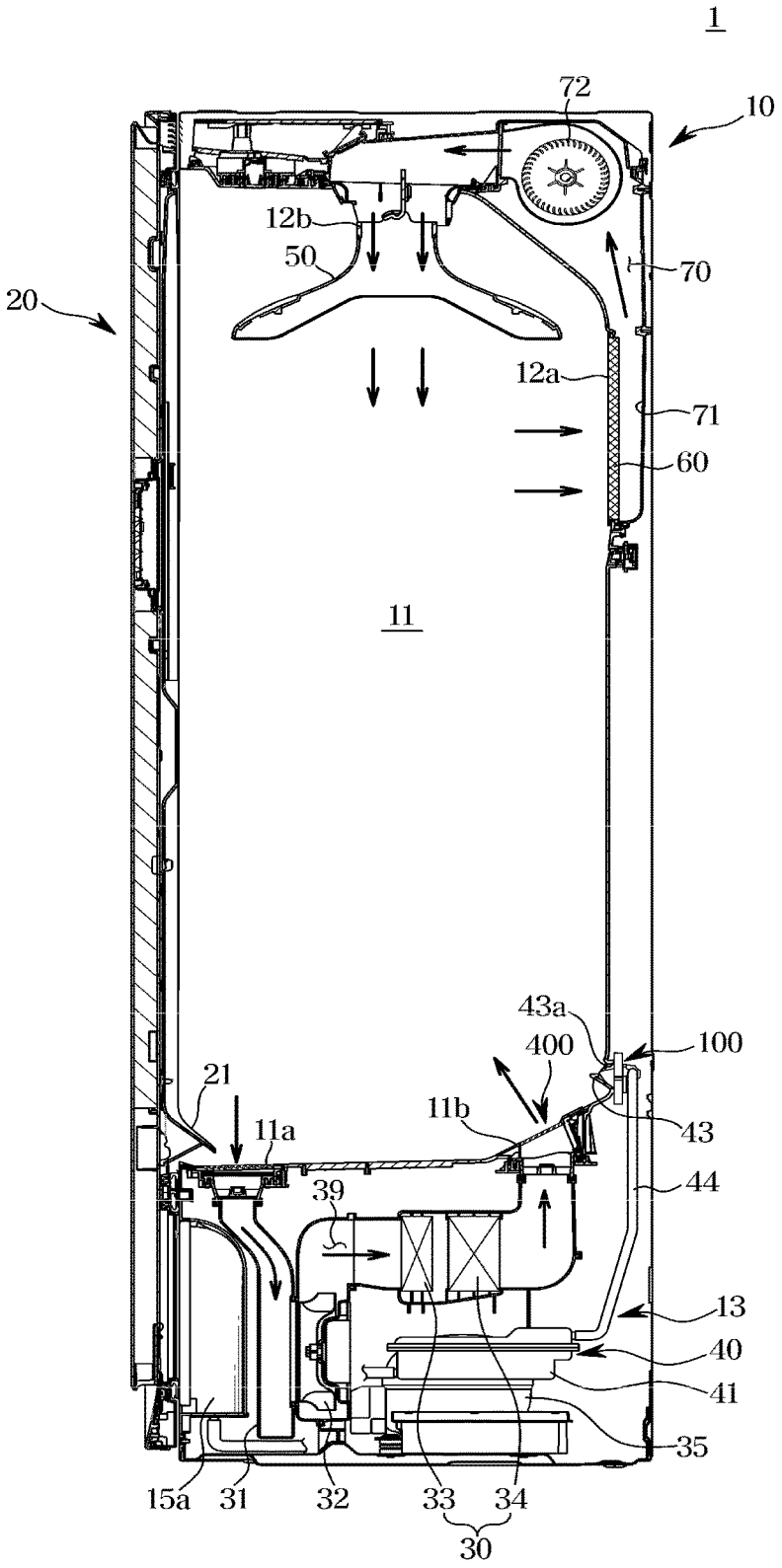
FIG. 2 is a cross-sectional view of a clothes care device according to an embodiment of the disclosure.
Figure 3:
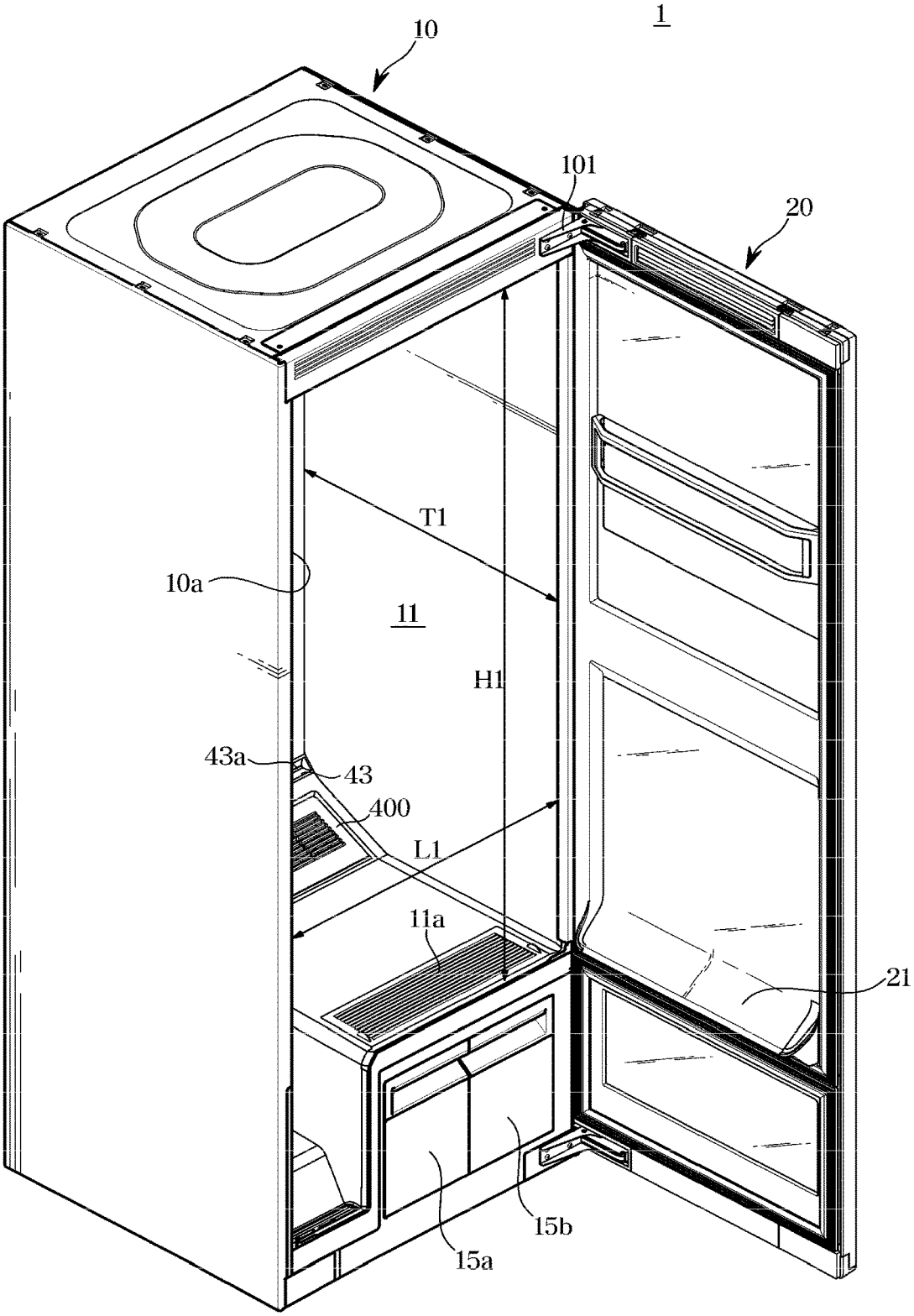
FIG. 3 shows a clothes care device according to an embodiment of the disclosure when a door opens.

FIG. 1 is a perspective view of a clothes care device according to an embodiment of the disclosure. FIG. 2 is a cross-sectional view of the clothes care device according to an embodiment of the disclosure. FIG. 3 shows the clothes care device according to an embodiment of the disclosure when a door opens.

As shown in FIGS. 1 to 3, a clothes care device 1 may include a main body 10 forming an outer appearance, a door 20 rotatably coupled to the main body 10, a clothes care chamber 11 formed inside the main body 10 to accommodate and care clothes, a clothes supporting member 50 provided inside the clothes care chamber 11 to hold clothes, and a machine room 13 in which a heat exchanger 30 for heating or dehumidifying inside air of the clothes care chamber 11 is installed.

The main body 10 may form the clothes care chamber 11 in the inside, and be in a shape of a rectangular parallelopiped of which one side opens. In a front side of the main body 10, an opening 10*a* may be formed. In the opening 10*a* of the main body 10, a door 20 rotatably coupled to the main body 10 to open and close the main body 10 may be installed. The door 20 may open and close the clothes care chamber 11. The door 20 may be installed on the main body 10 through a connection member such as a hinge 101.

The clothes care chamber 11 may form a space in which clothes are accommodated. Inside the clothes care chamber 11, the clothes supporting member 50 for holding and supporting clothes may be provided. The clothes supporting member 50 may be removably mounted on a top of the clothes care chamber 11. At least one clothes supporting member 50 may be provided. The clothes supporting member 50 may be in a shape of a hanger for hanging clothes. Air may flow inside the clothes supporting member 50. Dust or foreign materials gathered on clothes may be removed by air supplied to inside of the clothes supporting member 50.

The clothes care chamber 11 may include a first air flow inlet 11*a*, a second air flow inlet 12*a*, a first air flow outlet 11*b*, a second air flow outlet 12*b*, and a steam outlet 43*a*. The first air flow inlet 11*a* and the first air flow outlet 11*b* may be formed in a bottom of the clothes care chamber 11. The first air flow inlet 11*a* may be positioned in a front area of the bottom of the clothes care chamber 11, and the first air flow outlet 11*b* may be positioned in a rear area of the bottom of the clothes care chamber 11. The second air flow inlet 12*a* may be formed in a rear side of the clothes care chamber 11. The second air flow outlet 12*b* may be formed in a center of the top of the clothes care chamber 11. The second air flow inlet 12*a* may be adjacent to the second air flow outlet 12*b*.

In the first air flow outlet 11*b*, an outlet grille 400 for uniformly dispersing an air flow inside the clothes care chamber 11 may be provided. The outlet grille 400 will be described later.

The second air flow outlet 12*b* of the clothes care chamber 11 may be connected to the clothes supporting member 50. Air discharged through the second air flow outlet 12*b* may be transferred to clothes hanging on the clothes supporting member 50 through an air hole 51 formed in the clothes supporting member 50.

In a lower portion of the main body 10, a drain container 15*a* and a water supply container 15*b* may be installed in such a way to be removable from the main body 10. The drain container 15*a* and the water supply container 15*b* may be positioned below the clothes care chamber 11. The drain container 15*a* may be provided to easily process condensed water. In the water supply container 15*b*, water required to generate a steam by a steam generator 40 which will be described later may be stored. The water stored in the water supply container 15*b* may be supplied to the steam generator 40 to be used to generate a steam. The water supply container 15*b* may be removably installed in the main body 10 to easily add water in the supply container 15*b*.

The drain container 15*a* and the water supply container 15*b* may be positioned in a front area of the machine room 13. The machine room 13 may be positioned in the lower portion of the main body 10. The machine room 13 may be positioned below the clothes care chamber 11. The machine room 13 may include the heat exchanger 30 for heating and dehumidifying inside air of the clothes care chamber 11 as necessary.

Inside the machine room 13, a blow fan 32, the heat exchanger 30, and the steam generator 40 may be positioned.

The heat exchanger 30 may supply hot air to the inside of the clothes care chamber 11. The heat exchanger 30 may include an evaporator 33, a compressor 35, a condenser 34 through which a refrigerant circulates, and may dehumidify and heat air.

In the evaporator 33 of the heat exchanger 30, a refrigerant may evaporate to absorb latent heat of surrounding air, and condense and remove water in the air. Also, when the refrigerant is condensed in the condenser 34 via the compressor 35, the refrigerant may emit the latent heat toward the surrounding air to thereby heat the surrounding air. That is, the evaporator 33 and the condenser 34 may function as a heat exchanger, so that air entered the machine room 13 by the blow fan 32 may be dehumidified and heated by passing through the evaporator 33 and the condenser 34 sequentially.

The heat exchanger 30 installed in the machine room 13 may include a first duct 31 connecting the evaporator 33, the condenser 34, and the blow fan 32 to each other, and the first duct 31 may be connected to the clothes care chamber 11, thereby forming a first circulating flow path 39 for circulating air between the clothes care chamber 11 and the first duct 31.

The first duct 31 may be connected to the first air flow inlet 11*a* and the first air flow outlet 11*b* of the clothes care chamber 11. Inside air of the clothes care chamber 11 may enter the first duct 31 through the first air flow inlet 11*a*, and the air may be dehumidified and then again discharged to the clothes care chamber 11 through the first air flow outlet 11*b*.

The first duct 31 may dehumidify the air entered through the first air flow inlet 11*a* and discharge the dehumidified air through the first air flow outlet 11*b*. The blow fan 32 may be positioned on the first duct 31 to inhale air of the clothes care chamber 11 to inside of the first duct 31.

Air of the clothes care chamber 11 may enter the first circulating flow path 39 through the first air flow inlet 11*a*. The entered air may pass through the heat exchanger 30 to be dehumidified and heated, and the dehumidified and heated air may be again discharged to the clothes care chamber 11 through the first air flow outlet 11*b*.

The steam generator 40 may be positioned in the machine room 13. The steam generator 40 may receive water from the water supply container 15*b* of the machine room 13 to generate a steam.

The steam generator 40 may include a steam generating portion 41 connected to the water supply container 15*b* to receive water and generate a steam, and a steam supply pipe 44 for guiding the generated steam to a steam spray 100 which will be described later. The steam spray 100 may be positioned in a lower area of the rear side of the clothes care chamber 11. Inside the steam generating portion 41, a heater (not shown) may be installed to heat water.

In the rear side of the clothes care chamber 11, a steam spray installing portion 43 in which the steam spray 100 is installed may be provided. The steam spray installing portion 43 may be formed in at least one area of the rear side of the clothes care chamber 11. The steam spray installing portion 43 according to an embodiment of the disclosure is shown to be installed in an area of the rear side of the clothes care chamber 11, however, a concept of the disclosure is not limited to this. For example, the steam spray installing portion 43 may be formed as a separate bracket and assembled. The steam spray installing portion 43 may include the steam outlet 43*a* corresponding to a steam spray opening 111*a* which will be described later.

The door 20 may include a door guide 21 for guiding a movement of condensed water. The door guide 21 may guide condensed water condensed on a rear surface of the door 20. The door guide 21 may be inclined downward toward the clothes care chamber 30 from the rear surface of the door 20. Condensed water entered through the first air flow inlet 11*a* may move to the drain container 15*a* by a connection member (not shown).

The clothes care chamber 11 may include a blower 72 for causing inside air to flow. The clothes care chamber 11 may include a second duct 71, and the blower 72 may be installed inside the second duct 71. The second duct 71 may communicate with the clothes care chamber 11 to form a second circulating flow path 70 circulating air between the clothes care chamber 11 and the second duct 71. The blower 72 may be positioned on the second circulating flow path 70. The second duct 71 may be formed behind the second air flow inlet 12 of the clothes care chamber 11. The second duct 71 may be positioned in an upper area of the rear side of the clothes care chamber 11, and include a filter member 60 inside the second duct 71.

The second duct 71 may be connected to the second air flow inlet 12*a* and the second air flow outlet 12*b* of the clothes care chamber 11. The second air flow outlet 12*b* may be connected to the clothes supporting member 50 to transfer inside air of the second duct 71 to the clothes supporting member 50.

The blower 72 installed inside the second duct 71 may inhale inside air of the clothes care chamber 11 through the second air flow inlet 12*a* and discharge the inside air to a second duct outlet (not shown) and the second air flow outlet 12*b*.

Inside air of the clothes care chamber 11 may be, when entering the second duct 71, filtered by the filter member 60 of the second air flow inlet 12*a*. Dust and smell contained in the air entered the second duct 71 may be removed by the filter member 60.

When a user starts clothes caring, the user may operate the clothes care chamber 11 after hanging clothes on the clothes supporting member 50 and closing the door 20. Then, inside the clothes care chamber 11, air may circulate along the first circulating flow path 39 and the second circulating flow path 70.

Figure 4:
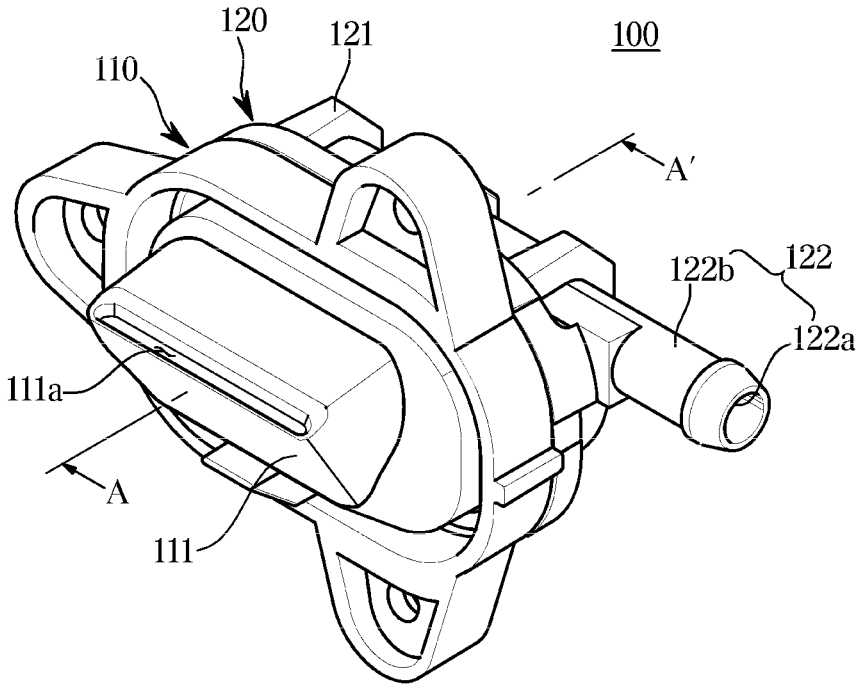
FIG. 4 is a perspective view of a steam spray of a clothes care device according to an embodiment of the disclosure.
Figure 5:
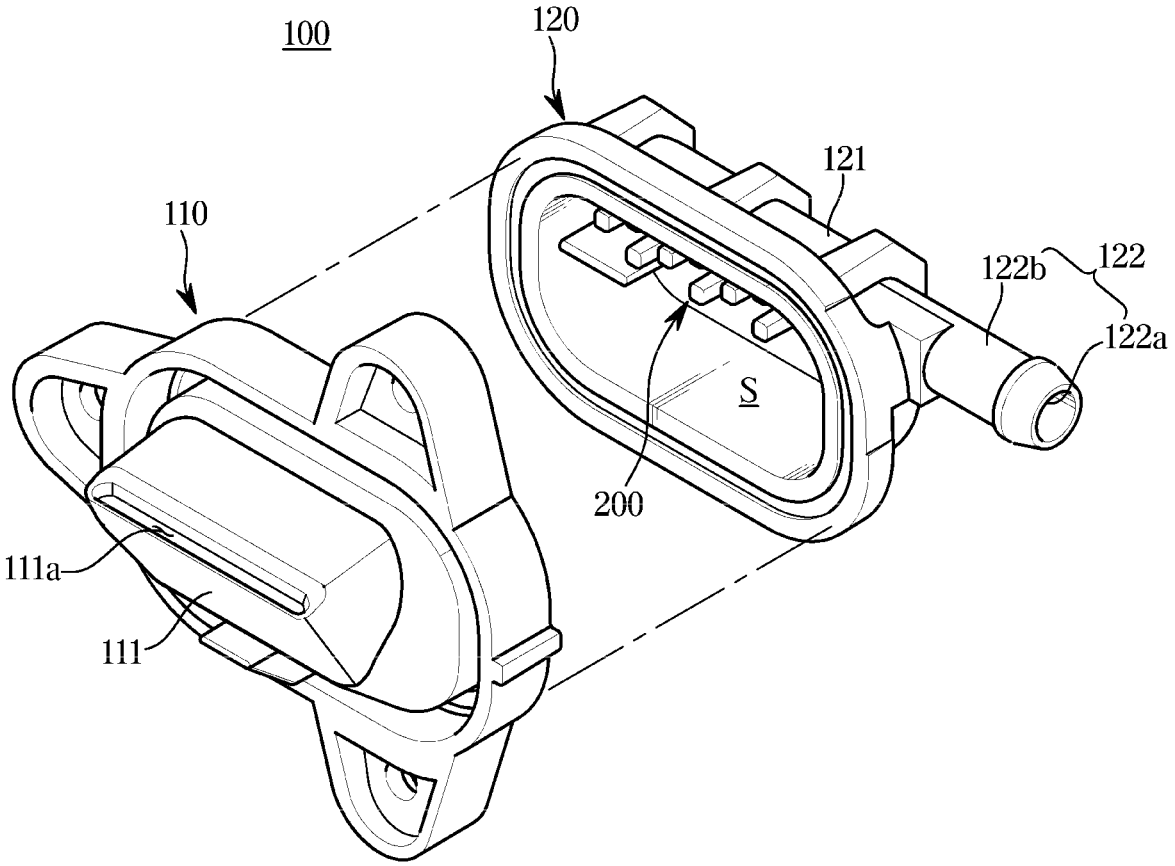
FIG. 5 is an exploded perspective view showing a steam nozzle and a nozzle cover of a steam spray according to an embodiment of the disclosure.
Figure 6:
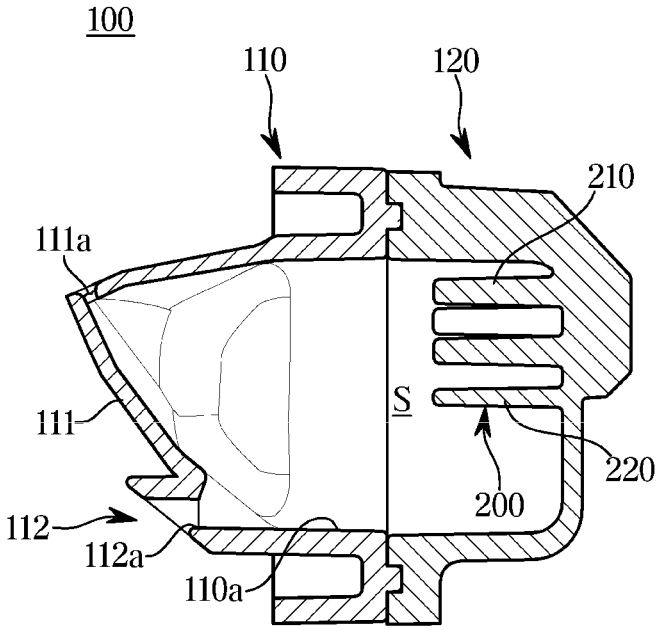
FIG. 6 is a cross-sectional view taken along line A-A' of FIG. 4.
Figure 7:
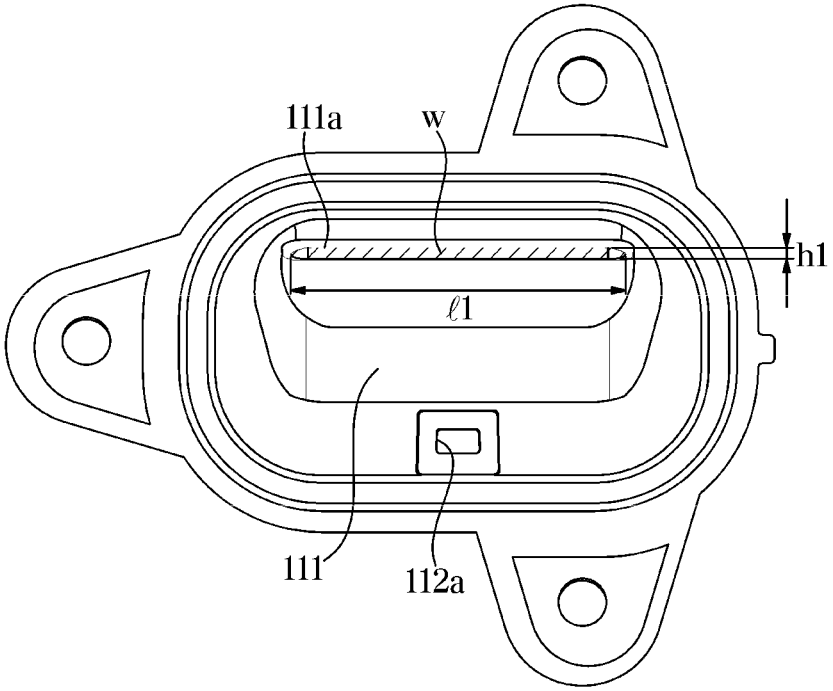
FIG. 7 shows a steam nozzle according to an embodiment of the disclosure.
Figure 8:
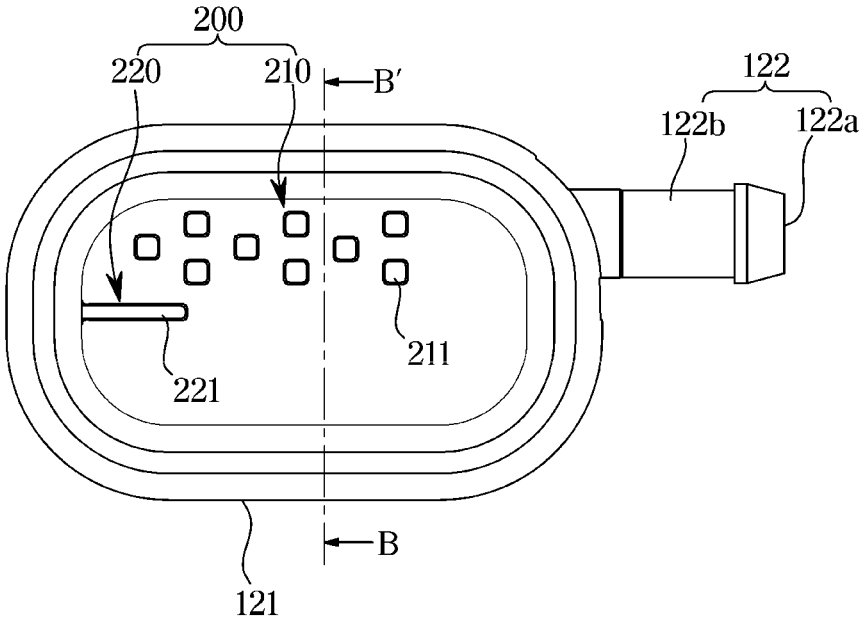
FIG. 8 shows a guide member of a nozzle cover according to an embodiment of the disclosure.
Figure 9:
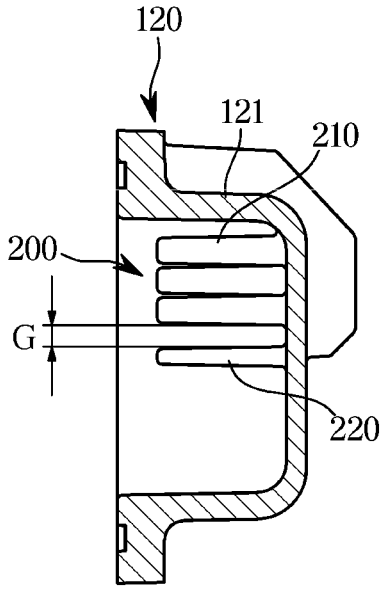
FIG. 9 is a cross-sectional view taken along B-B' of FIG. 8.
Figure 10:
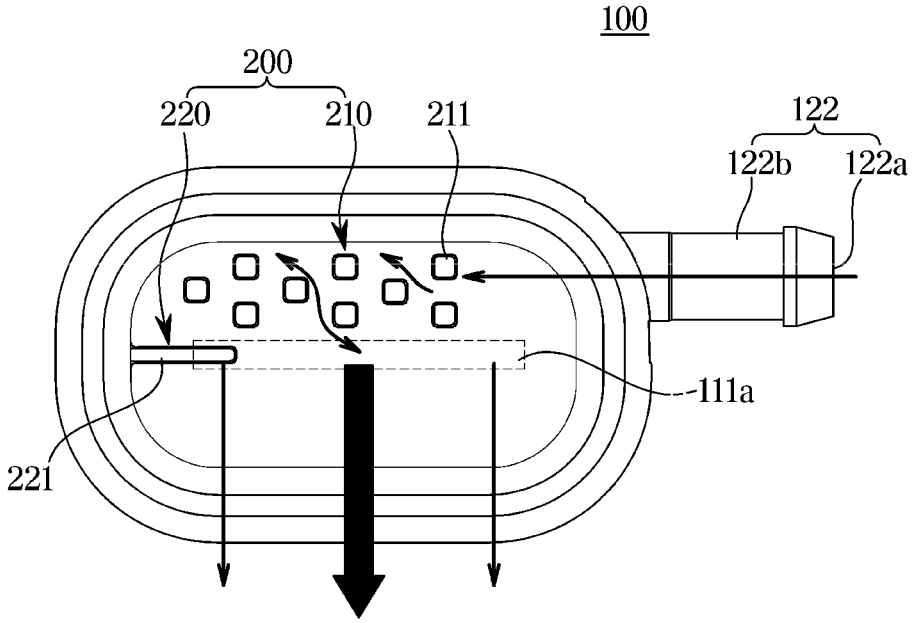
FIG. 10 shows a spray direction of a steam according to a guide member according to an embodiment of the disclosure.

FIG. 4 is a perspective view of the steam spray 100 of the clothes care device 1 according to an embodiment of the disclosure, FIG. 5 is an exploded perspective view showing a steam nozzle and a nozzle cover of the steam spray 100 according to an embodiment of the disclosure, FIG. 6 is a cross-sectional view taken along line A-A' of FIG. 4, FIG. 7 shows the steam nozzle according to an embodiment of the disclosure, FIG. 8 shows a guide member of a nozzle cover according to an embodiment of the disclosure, FIG. 9 is a cross-sectional view taken along B-B' of FIG. 8, and FIG. 10 shows a spray direction of a steam according to a guide member according to an embodiment of the disclosure.

As shown in FIGS. 4 to 10, the steam spray 100 may be positioned in the lower area of the rear side of the clothes care chamber 11 of the clothes care device 1.

The steam spray 100 may include a steam nozzle 110 and a nozzle cover 120. The steam nozzle 110 may include a steam discharge portion 111 for spraying a steam to the clothes care chamber 11, and a condensed water discharge portion 112 for discharging condensed water generated in the steam spray 100 to the clothes care chamber 11.

The steam discharge portion 111 may be inclined upward toward the clothes care chamber 11 in which clothes are held. The steam discharge portion 111 may spray a steam supplied through a steam inlet pipe 122*b* upward toward the clothes care chamber 11. The steam spray opening 111*a* may be formed in the steam discharge portion 111. The steam spray opening 111*a* may be formed at an upper end of the steam discharge portion 111.

The steam spray opening 111*a* may cause a steam to be sprayed upward to the inside of the clothes care chamber 11.

The condensed water discharge portion 112 may be formed in the steam discharge portion 111. The condensed water discharge portion 112 may discharge condensed water to the bottom of the clothes care chamber 11. The condensed water discharge portion 112 may be formed in a lower portion of the steam nozzle 110 to discharge condensed water by gravity. The condensed water discharge portion 112 may include a condensed water outlet 112*a* for discharging condensed water. The condensed water outlet 112*a* may be positioned in the lower portion of the steam nozzle 110. The condensed water outlet 112*a* may extend from a bottom 110*a* of the steam nozzle 110. Condensed water discharged through the condensed water outlet 112*a* may be discharged to the inside of the clothes care chamber 11.

The nozzle cover 120 coupled to the steam nozzle 110 may cover a rear side of the steam nozzle 110. The steam nozzle 110 may be coupled to the nozzle cover 120 by welding. When the steam nozzle 110 is coupled to the nozzle cover 120 by welding, an inside steam may be prevented from leaking out. A steam may enter a space S formed by the steam nozzle 110 and the nozzle cover 120, and be sprayed to the inside of the clothes care chamber 11 through the steam spray opening 111*a* of the steam nozzle 110.

The nozzle cover 120 may include a nozzle cover body 121 coupled to the steam nozzle 110 to form the space S, and a steam inlet portion 122 formed in the nozzle cover body 121.

The nozzle cover 120 may include the steam inlet portion 122 which a steam supplied through the steam inlet pipe 122*b* enters. The steam inlet pipe 122*b* may include a steam inlet 122*a* through which a steam to be transferred through the steam inlet pipe 122*b* enters the inside of the nozzle cover 120. A steam entered through the steam inlet 122*a* may have strong pressure and a rotation force.

The steam inlet portion 122 may be formed on one side of the nozzle cover body 1221. The steam inlet portion 122 may be connected in a horizontal direction to one side of the nozzle cover body 121 to cause a steam to enter in the horizontal direction.

The steam spray 100 may include a guide member 200 for mitigating pressure and a rotation force of a steam entered through the steam inlet 122*a*.

The guide member 200 of the steam spray 100 may be positioned on the nozzle cover 120. The guide member 200 may be positioned on a moving path of a steam entered through the steam inlet 122*a*. The guide member 200 may cover at least one portion of the moving path of the steam entered through the steam inlet 122*a*. The guide member 200 may not completely cover the steam inlet 122*a*. The guide member 200 may be positioned alongside a flow direction of a steam entered the nozzle cover 120.

The guide member 200 may include a first guide 210 for covering at least one portion of a moving path of a steam entered through the steam inlet 122*a*, and a second guide 220 positioned outside the first guide 210.

The first guide 210 may be positioned on a moving path of a steam entered through the steam inlet 122*a* to mitigate pressure of the steam. The second guide 220 may mitigate a rotation force of the steam. The second guide 220 may prevent the steam entered through the steam inlet 122*a* from forming a rotating flow path.

The first guide 210 may include a plurality of poles 211. The first guide 210 may include the plurality of poles 211 each being in a shape of a square pillar. The plurality of poles 211 may be spaced from each other. The first guide 210, that is, the plurality of poles 211 may mitigate pressure of a steam entered through the steam inlet 122*a* to keep a direction of the steam sprayed through the steam spray opening 111*a* constant. According to the current embodiment of the disclosure, the first guide 210 may include 9 poles 211, however, a concept of the disclosure is not limited to this.

A cross section of the first guide 210 may be at least one of a straight line, a quadrangle, a triangle, or a curve.

The second guide 220 may be positioned in the horizontal direction in a lower edge of the first guide 210. The second guide 220 may include a plate-shaped rib 221 formed in the horizontal direction in the lower edge of the first guide 210. The plate-shaped rib 221 formed in the horizontal direction on the nozzle cover 120 may prevent a steam entered through the steam inlet 122*a* from forming a rotating flow path by an inner wall of the nozzle cover body 121. The second guide 220 may be positioned in a lower side of the first guide 210. The second guide 220 may be positioned in the horizontal direction in the lower side of the first guide 210. In the current embodiment of the disclosure, an example in which a single second guide 220 is positioned in the lower side of the first guide 210 is shown, however, a concept of the disclosure is not limited to this. For example, a plurality of first guides 210 may be arranged and spaced from each other, and the second guide 220 may be spaced a predetermined distance G from the first guides 210. A horizontal length and thickness of the second guide 220 may change. The second guide 220 may mitigate a rotation force of a steam to keep a direction of the steam sprayed through the steam spray opening 111*a* constant.

In the current embodiment of the disclosure, an example in which a height of the second guide 220 is the same as that of the first guide 210 is shown, however, a concept of the disclosure is not limited to this. For example, the height of the second guide 220 may be different from that of the first guide 210.

The first guide 210 may mitigate pressure of a steam entered through the steam inlet 122*a*, and the second guide 220 may mitigate a rotation force of the steam to keep a spray direction of the steam constant. By keeping the spray direction of the steam constant, steam transfer efficiency may be improved, and accordingly, a steam amount applied to clothes may be improved.

Figure 11:
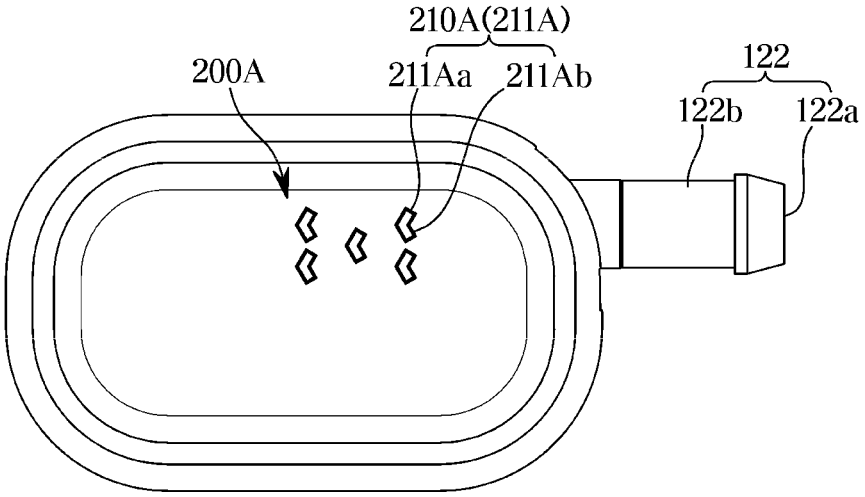
FIG. 11 shows a guide member of a nozzle cover according to another embodiment of the disclosure.

FIG. 11 shows a guide member of a nozzle cover according to another embodiment of the disclosure. Reference numerals not shown in FIG. 11 will be understood by referring to FIGS. 1 to 10.

Hereinafter, overlapping descriptions will be omitted.

As shown in FIG. 11, a guide member 200A of the steam spray 100 may include a first guide 210A positioned on a moving path of a steam entered through the steam inlet 122*a*.

The first guide 210A may be positioned on the moving path of the steam entered through the steam inlet 122*a* to mitigate pressure of the steam. The first guide 210A may include a plurality of protrusions 211A. A cross section of each protrusion 211A may be substantially in a shape of a triangle. Each of the plurality of protrusions 211A may include a first protrusion 211Aa and a second protrusion 211Ab extending downward from one end of the first protrusion 211Aa. The first protrusion 211Aa and the second protrusion 211Ab may form a preset angle. Pressure of a steam entered through the steam inlet 122*a* may be mitigated by the plurality of protrusions 211A. The first guide 210A, that is, the plurality of protrusions 211A may mitigate the pressure of the steam entered through the steam inlet 122*a* to keep a direction of the steam sprayed through the steam spray opening 111*a* constant. In the current embodiment of the disclosure, an example in which 5 protrusions 211*a* are provided is shown, however, a concept of the disclosure is not limited to this.

According to the configuration, the first guide 210A of the guide member 200A according to another embodiment of the disclosure may mitigate pressure of a steam entered through the steam inlet 122*a*, and accordingly, the first guide 210A may keep a spray direction of the steam constant.

Figure 12:
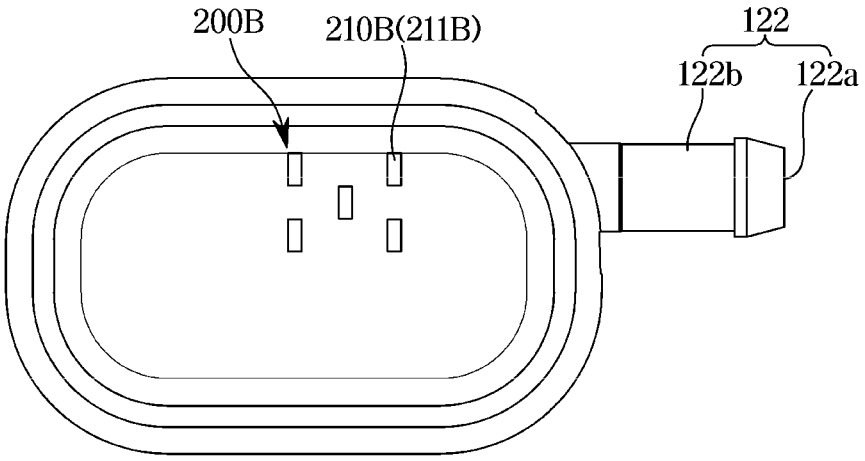
FIG. 12 shows a guide member of a nozzle cover according to another embodiment of the disclosure.

FIG. 12 shows a guide member of a nozzle cover according to another embodiment of the disclosure. Reference numerals not shown in FIG. 12 will be understood by referring to FIGS. 1 to 10.

Hereinafter, overlapping descriptions will be omitted.

As shown in FIG. 12, the guide member 200 of the steam spray 100 may include a first guide 210B positioned on a moving path of a steam entered through the steam inlet 122*a*.

The first guide 210B may be positioned on the moving path of the steam entered through the steam inlet 122*a* to mitigate pressure of the steam. The first guide 210B may include a plurality of bars 211B. A cross section of each bar 211B may be substantially in a shape of a quadrangle. Pressure of a steam entered through the steam inlet 122*a* may be mitigated by the plurality of bars 211B. The first guide 210B, that is, the plurality of bars 211B may mitigate pressure of a steam entered through the steam inlet 122*a* to keep a direction of a steam sprayed through the steam spray opening 111*a* constant. In the current embodiment of the disclosure, an example in which 5 first guides 210B are provided is shown, however, a concept of the disclosure is not limited to this.

According to the configuration, the first guide 210B of the guide member 200 according to another embodiment of the disclosure may mitigate pressure of a steam entered through the steam inlet 122*a*, and accordingly, the first guide 210B may keep a spray direction of the steam constant.

Figure 13:
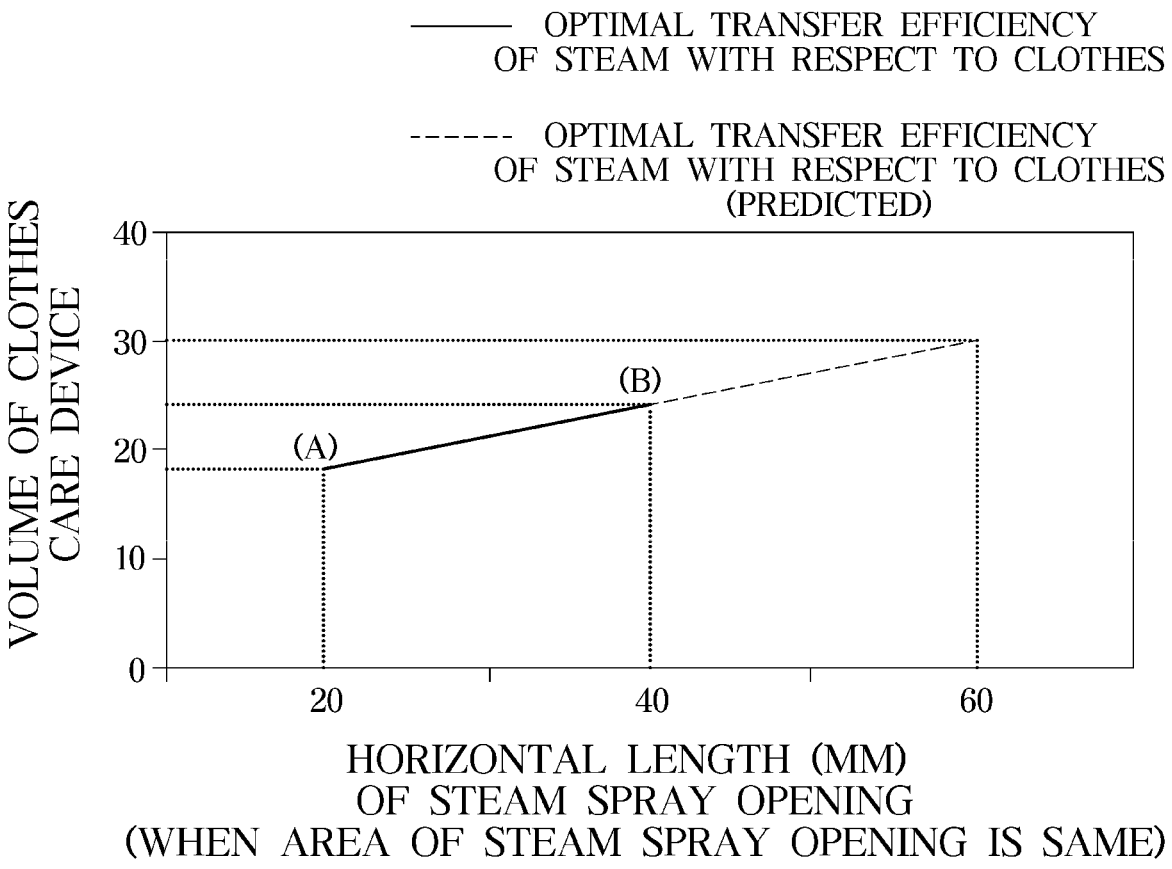
FIG. 13 shows a change of a length of a steam spray opening of a steam nozzle according to an embodiment of the disclosure according to a volume of a clothes care chamber.

FIG. 13 shows a change of a length of a steam spray opening of a steam nozzle according to an embodiment of the disclosure according to a volume of the clothes care chamber 11. Reference numerals not shown in FIG. 13 will be understood by referring to FIGS. 1 to 10.

As shown in FIG. 13, the steam spray opening 111*a* of the steam spray 100 may have a first area w. The first area w of the steam spray opening 111*a* may be defined by a vertical length h1 and a horizontal length l1 of the steam spray opening 111*a* (see FIG. 7).

The first area w of the steam spray opening 111*a* may have different shapes according to an internal volume W (that is, a processing volume) of the clothes care chamber 11 of the clothes care device 1.

The internal volume W of the clothes care chamber 11 may be defined by a vertical length H1, a horizontal length L1, and a width T1 of the clothes care chamber 11 (see FIG. 3).

Also, the first area w of the steam spray opening 111*a* may depend on the internal volume W of the clothes care chamber 11. The first area w of the steam spray opening 111*a* may have the horizontal length l1 that changes according to the internal volume W of the clothes care chamber 11 and is maintained at a preset ratio with respect to the horizontal length L1 of the clothes care chamber 11.

For example, when the horizontal length L1 of the clothes care chamber 111 is 380 mm, the horizontal length l1 of the steam spray opening 111*a* may be 20 mm. In this case, a ratio of the horizontal length l1 of the steam spray opening 111*a* with respect to the horizontal length L1 of the clothes care chamber 11 may be 5.26%. When the horizontal length L1 of the clothes care chamber 11 is 550 mm, the horizontal length l1 of the steam spray opening 111*a* may be 40 mm. In this case, a ratio of the horizontal length l1 of the steam spray opening 111*a* with respect to the horizontal length L1 of the clothes care chamber 11 may be 7.27%.

| | | A | B |
|---|---|---|---|
| Internal Volume of the Clothes Care Chamber W * H * T (mm) | | 380 * 1350 * 515 | 550 * 1500 * 515* + (130 * 150 * 515) |
| | Volume | 276, 040, 681 | 448, 995, 560 |
| Steam Amount Applied to Clothes (RMC, %) | When the Horizontal Length of the Steam Spray Opening Is 20 mm | 14.1 | 10.5 |
| | When the Horizontal Length of the Steam Spray Opening Is 40 mm | 12.3 | 19 |

As seen in the above Table, when the clothes care chamber 11 has a volume W of about 276,040,681 $mm^2$ corresponding to horizontal length (L1)*vertical length (H1)*width (T1) of 380*1350*515 and the horizontal length l1 of the steam spray opening 111*a* is 20 mm, a steam amount applied to clothes may be 14.1%, and, when the horizontal length l1 of the steam spray opening 111*a* is 40 mm(A), a steam amount applied to clothes may be 12.3%.

Also, when the clothes care chamber 11 has a volume W of about 448,995,560 $mm^2$ corresponding to horizontal length (L1)*vertical length (H1)*width (T1) of 550*1500*515+(130*150*515) and the horizontal length l1 of the steam spray opening 111*a* is 20 mm, a steam amount applied to clothes may be 10.5%, and, when the horizontal length l1 of the steam spray opening 111*a* is 40 mm(B), a steam amount applied to clothes may be 19%. In this case, the area w of the steam spray opening 111*a* may be the same.

Accordingly, when the internal volume W of the clothes care chamber 11 increases, steam transfer efficiency may be improved by increasing the horizontal length l1 of the steam spray opening 111*a*.

That is, by changing the vertical length h1 and the horizontal length l1 of the steam spray opening 111*a* according to the internal volume W of the clothes care chamber 11, while maintaining the area w of the steam spray opening 111*a* constant, a steam amount applied to clothes may increase.

Figure 14:
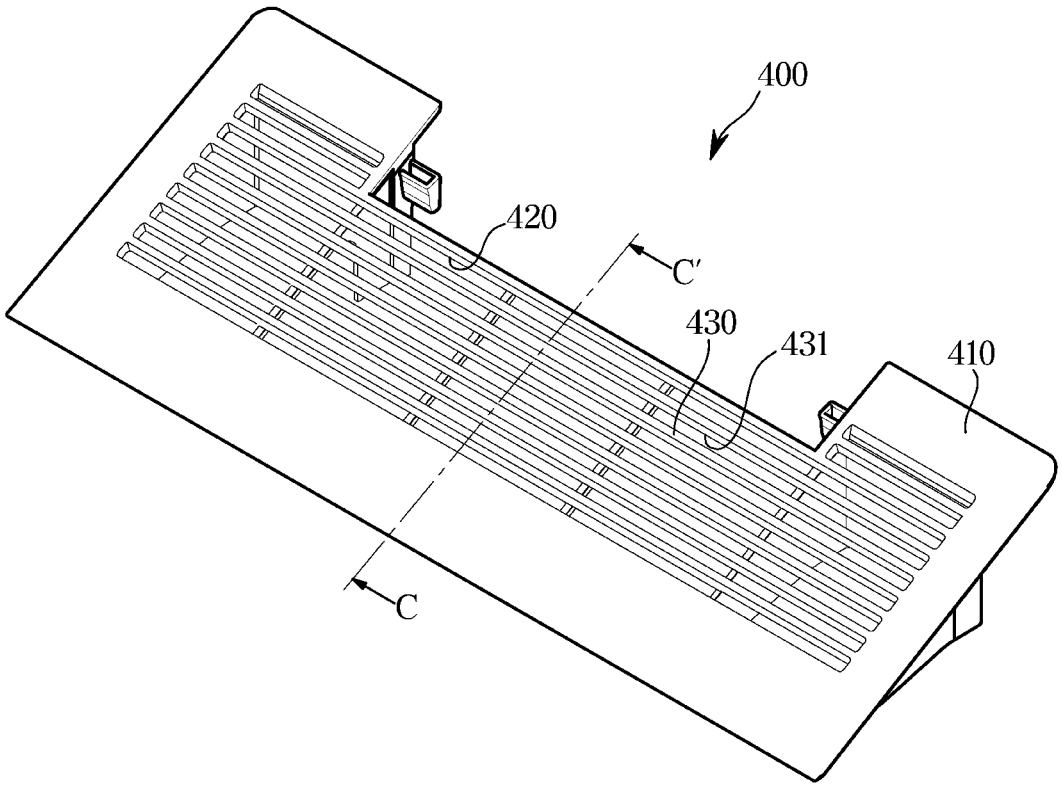
FIG. 14 is a perspective view of an outlet grille according to an embodiment of the disclosure.
Figure 15:
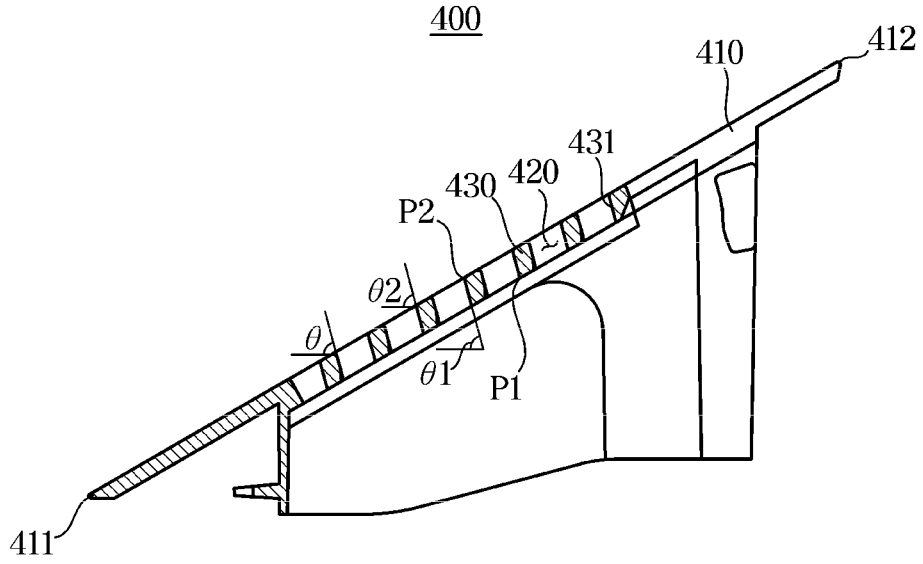
FIG. 15 is a cross-sectional view taken along line C-C' of FIG. 14, showing an angle of the outlet grille according to an embodiment of the disclosure.
Figure 16:
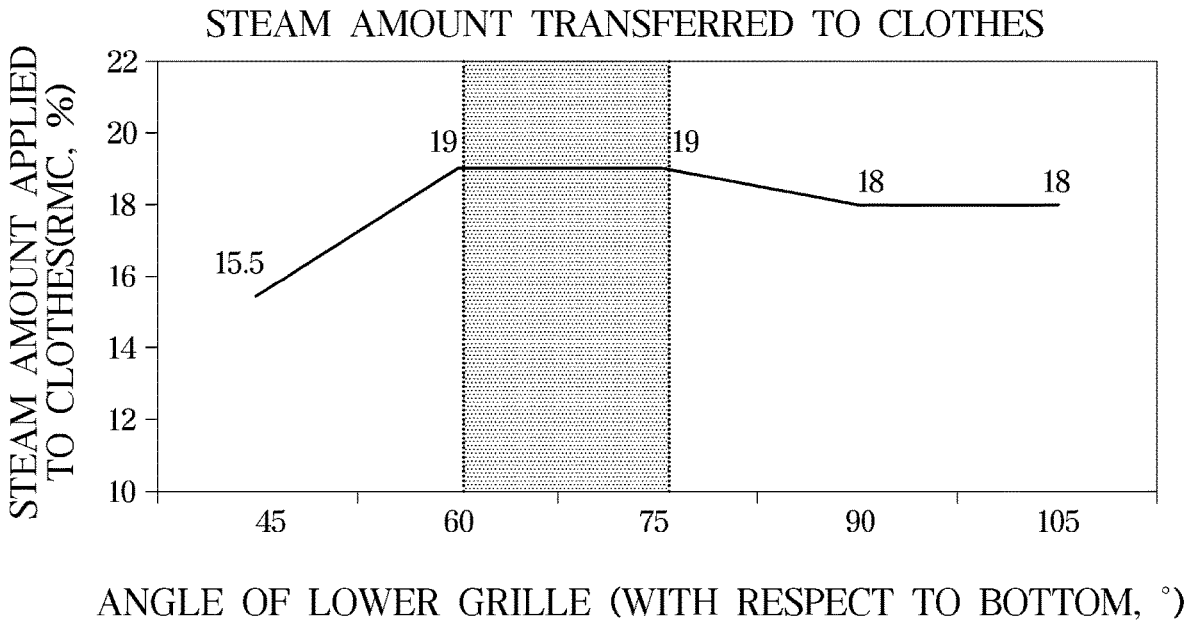
FIG. 16 is a graph showing steam amounts applied to clothes according to angles of an outlet grille according to an embodiment of the disclosure.
Figure 17:
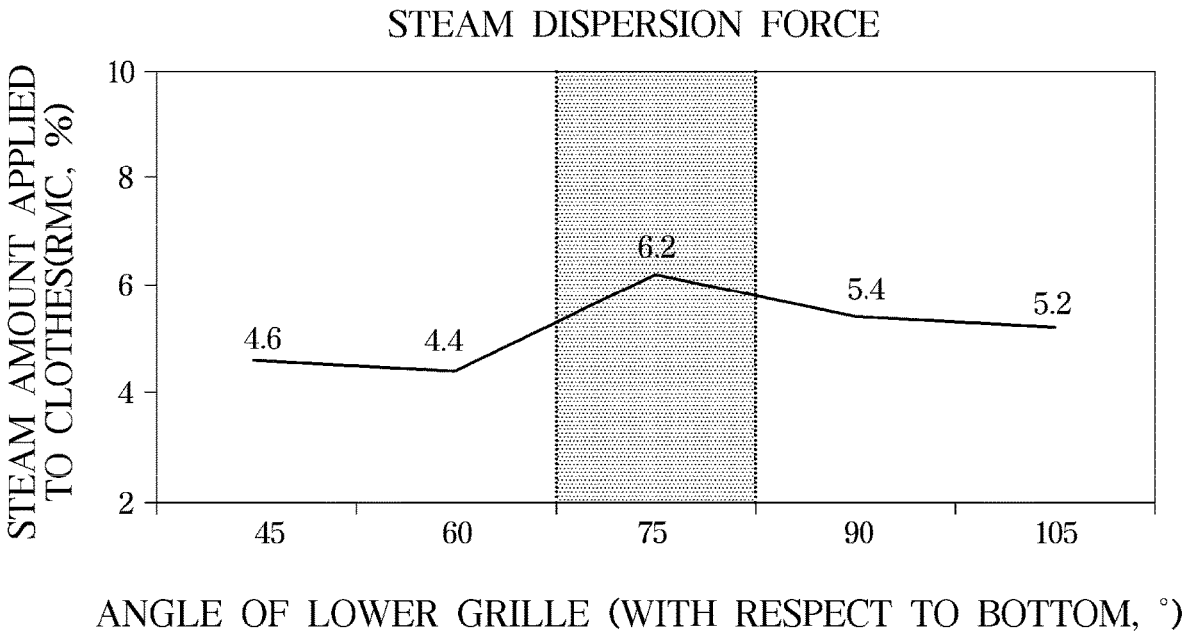
FIG. 17 is a graph showing steam amounts applied to clothes and steam dispersion forces according to angles of an outlet grille according to an embodiment of the disclosure.

FIG. 14 is a perspective view of the outlet grille 400 according to an embodiment of the disclosure, FIG. 15 is a cross-sectional view taken along line C-C' of FIG. 14, showing an angle of the outlet grille 400 according to an embodiment of the disclosure, FIG. 16 is a graph showing steam amounts applied to clothes according to angles of an outlet grille according to an embodiment of the disclosure, and FIG. 17 is a graph showing steam amounts applied to clothes and steam dispersion forces according to angles of an outlet grille according to an embodiment of the disclosure.

Reference numerals not shown in FIGS. 14 to 17 will be understood by referring to FIGS. 1 to 10.

As shown in FIGS. 14 to 17, the clothes care device 1 may include the outlet grille 400 positioned on the first air flow outlet 11*b*.

The outlet grille 400 may be mounted on the first air flow outlet 11*b* to uniformly discharge air of the first circulating flow path 39 to the inside of the clothes care chamber 11.

The outlet grille 400 may have a size and shape corresponding to the first air flow outlet 11*b*. The outlet grille 400 may include an outlet grille body 410 being in a shape of a plate. The outlet grill body 410 may include a first end portion 411 formed at the lower end, and a second end portion 412 formed at the upper end. The first end portion 411 and the second end portion 412 may be positioned at different locations. The first end portion 411 may be positioned at a location that is lower than the second end portion 412, and the second end portion 412 may be positioned at a location that is higher than the first end portion 411.

In the outlet grille body 410, an outlet guide 430 forming an outlet hole 420 may be provided. In the outlet guide 430, an inclined surface 431 for forming an outlet angle of the outlet hole 420 may be formed. An angle θ of the inclined surface 431 of the outlet guide 430 may range from 60° to 85°. When the angle θ of the inclined surface 431 of the outlet guide 430 ranges from 60° to 85°, air discharged through the outlet hole 420 of the outlet grille 40 may be dispersed most widely.

The outlet guide 430 may have a first position P1 at which air enters the outlet hole 420 and a second position P2 at which air is discharged through the outlet hole 420. The first position P1 of the outlet guide 430 may have a first angle θ1, and the second position P2 of the outlet guide 430 may have a second angle θ2. The first angle θ1 of the first position P1 may be equal to or different from the second angle 82 of the second position P2. The first angle θ1 and the second angle θ2 may range from 60° to 85°. In the current embodiment of the disclosure, the outlet guide 430 forming the outlet hole 420 is shown to have the first angle θ1 of the first position P1 and the second angle θ2 of the second position P2, however, a concept of the disclosure is not limited to this. The outlet guide 430 may further have a third position formed between the first position P1 and the second position P2, and further have a third angle of the third position. The third angle may range from 60° to 85°.

As shown in FIGS. 16 and 17, when the angle of the outlet hole 420 of the outlet grille 400 ranges from 60° to 75°, a steam amount (RMC, %) applied to clothes may be 19% which is a greatest steam amount. In this case, a steam transfer amount of clothes may be a total of water amounts (RMC) included in 5 suits of clothes hanging in the clothes care chamber 11. The steam amount (RMC) applied to clothes may be (Weight of Clothes After Processing−Weight of Clothes before Processing)/(Weight of Clothes Before Processing)*100.

It is seen that the steam amount applied to clothes is great when the angle of the outlet hole 420 of the outlet grille 400 is equal to or greater than 60°.

As a steam amount applied to clothes increases, functions, such as smoothing out the wrinkles of clothes, deodorizing clothes, etc. may be improved.

Also, it is seen that, when the angle θ of the outlet hole 420 of the outlet grille 400 is 65° to 80°, a steam dispersion force is greatest. The steam dispersion force may be a sum of water amounts (RMC) included in two suits of clothes hanging in left and right ends of the clothes care chamber 11.

An angle θ of the outlet hole 420 of the outlet grille 400, satisfying both a steam amount applied to clothes and a steam dispersion force, may be 75° with respect to a bottom. When the angle θ of the outlet hole 420 of the outlet grille 400 is 75°, discharged air may have highest transfer efficiency of a steam sprayed from the steam spray 100 to clothes.

According to an embodiment of the disclosure, steam transfer efficiency may be improved, and accordingly, functions of smoothing out the wrinkles of clothes and deodorizing clothes may be improved.

Also, by mitigating pressure and a rotation force generated upon steam generation, a steam may be sprayed in a preset direction.

Also, by changing a shape of the steam spray opening according to a change of the internal volume of the clothes care device, a steam amount transferred to clothes may be improved to thereby effectively refresh the clothes.

Although a few embodiments of the disclosure have been shown and described, it would be appreciated by those skilled in the art that changes may be made in these embodiments without departing from the principles and spirit of the disclosure, the scope of which is defined in the claims and their equivalents.

What is claimed is:

1. A clothes care device comprising:

a main body including a clothes care chamber positioned inside of the main body, the clothes care chamber having a front side which opens;

a steam generator configured to supply steam to an inside of the clothes care chamber; and a steam spray configured to receive the steam from the steam generator and spray the steam to the inside of the clothes care chamber, wherein the steam spray includes, a steam nozzle having a steam spray opening to spray the steam to the inside of the clothes care chamber, a nozzle cover having a steam inlet which receives the steam from the steam generator while the nozzle cover is coupled to the steam nozzle, and a guide member positioned inside the nozzle cover along at least a portion of a moving path of the steam received through the steam inlet, the guide member formed to be stationary and configured to guide the steam received through the steam inlet along an exterior surface of the guide member to the steam spray opening.

2. The clothes care device according to claim 1, wherein the guide member comprises, a first guide positioned along the moving path of the steam and configured to mitigate pressure of the steam, and a second guide positioned outside an area of the first guide and configured to mitigate a rotation force of the steam.

3. The clothes care device according to claim 2, wherein the first guide comprises a plurality of poles.

4. The clothes care device according to claim 3, wherein the second guide includes a rib positioned in a horizontal direction along a lower edge of the first guide.

5. The clothes care device according to claim 2, wherein a cross section of the first guide is at least one of a straight line, a quadrangle, a triangle, or a curve.

6. The clothes care device according to claim 3, wherein the plurality of poles are spaced from each other.

7. The clothes care device according to claim 3, wherein a gap is formed between the first guide and the second guide.

8. The clothes care device according to claim 1, wherein a size of the steam spray opening is changeable according to a volume of the clothes care chamber and has a horizontal length maintained at a preset ratio with respect to a left-right length of the clothes care chamber.

9. The clothes care device according to claim 8, wherein an area w of the steam spray opening is defined by a vertical length and the horizontal length, and the vertical length and the horizontal length of the size of the steam spray opening is changeable according to an internal volume of the clothes care chamber, while the area of the steam spray opening is maintained.

10. The clothes care device according to claim 1, wherein the steam nozzle includes a condensed water outlet for discharging condensed water.

11. The clothes care device according to claim 1, wherein the clothes care chamber forms a circulating flow path for circulating air within the clothes care device, the clothes care chamber includes a first air flow inlet through which air from the clothes care chamber enters, and a first air flow outlet connected to the first air flow inlet through which air discharges to the clothes care chamber, wherein an outlet grille is provided in the first air flow outlet.

12. The clothes care device according to claim 11, wherein the outlet grille includes an outlet guide forming an outlet hole, and the outlet guide comprises an inclined surface.

13. The clothes care device according to claim 12, wherein an angle of the inclined surface ranges from 60° to 85°.

14. The clothes care device according to claim 13, wherein the inclined surface includes a first angle of a first position at which air enters, and a second angle of a second position at which air is discharged.

15. The clothes care device according to claim 14, wherein each of the first angle and the second angle ranges from 60° to 85°.

16. A clothes care device comprising:

a main body including a clothes care chamber positioned inside of the main body;

a steam generator configured to supply steam to an inside of the clothes care chamber; and a steam spray including a steam inlet to receive the steam from the steam generator, and a steam spray opening to spray the steam received from the steam generator to the inside of clothes care chamber, wherein the steam spray includes a guide member covering at least one portion of a moving path of the steam received through the steam inlet and the guide member configured to mitigate pressure of the steam received through the steam inlet and guide the steam received through the steam inlet along an exterior of the guide member to the steam spray opening.

17. The clothes care device according to claim 16, wherein the guide member comprises a first guide including a plurality of poles positioned along the moving path of the steam and spaced apart from each other, and a second guide positioned outside an area of the first guide and configured to mitigate a rotation force of the steam.

18. The clothes care device according to claim 17, wherein the second guide comprises a rib positioned in a horizontal direction in a lower edge of the first guide.

19. The clothes care device according to claim 17, wherein a cross section of the first guide is at least one of a straight line, a quadrangle, a triangle, or a curve.

20. The clothes care device according to claim 16, wherein a size of the steam spray opening is changeable according to a volume of the clothes care chamber and has a horizontal length maintained at a preset ratio with respect to a left-right length of the clothes care chamber.

21. A clothes care device comprising:

a main body including a clothes care chamber positioned inside of the main body;

a steam generator configured to supply steam to an inside of the clothes care chamber; and a steam spray including a steam inlet receiving the steam from the steam generator, and a steam spray opening spraying the steam to the inside of the clothes care chamber, and a guide member formed to be stationary and configured to guide the steam received through the steam inlet along an exterior of the guide member to the steam spray opening, wherein an area of the steam spray opening is changeable according to a volume of the clothes care chamber and has a horizontal length maintained at a preset ratio with respect to a left-right length of the clothes care chamber.

22. The clothes care device according to claim 21, wherein the area of the steam spray opening is defined by a vertical length and the horizontal length, and the vertical length and the horizontal length of the steam spray opening is changeable according to the internal volume of the clothes care chamber, while the area of the steam spray opening is maintained.

23. The clothes care device according to claim 21, wherein the horizontal length of the steam spray opening changes at a preset ratio with respect to a horizontal length of the clothes care chamber.

* * * * *